US005501459A

United States Patent [19]

Endo

[11] Patent Number: 5,501,459

[45] Date of Patent: Mar. 26, 1996

[54] HOLLOW CLUB HEAD WITH WEIGHTED SOLE PLATE

[75] Inventor: Eimatsu Endo, Tsubame, Japan

[73] Assignee: Kabushiki Kaisha Endo Seisakusho, Japan

[21] Appl. No.: 357,108

[22] Filed: Dec. 16, 1994

Related U.S. Application Data

[62] Division of Ser. No. 245,874, May 19, 1994.

[30] Foreign Application Priority Data

| | | | |
|---|---|---|---|
| May 19, 1993 | [JP] | Japan | 5-117328 |
| May 31, 1993 | [JP] | Japan | 5-129620 |
| Dec. 28, 1993 | [JP] | Japan | 5-334330 |
| Feb. 18, 1994 | [JP] | Japan | 6-21399 |
| Feb. 22, 1994 | [JP] | Japan | 6-24319 |
| Feb. 28, 1994 | [JP] | Japan | 6-30240 |
| Mar. 7, 1994 | [JP] | Japan | 6-35844 |
| Apr. 5, 1994 | [JP] | Japan | 6-67365 |
| Apr. 6, 1994 | [JP] | Japan | 6-68786 |

[51] Int. Cl.[6] ..... A63B 53/04

[52] U.S. Cl. ..... 273/167 H; 273/172; 273/167 A; 273/169; 273/167 F

[58] Field of Search ..... 273/167 H, 172, 273/173, 174, 167 A, 169, 167 F

[56] References Cited

U.S. PATENT DOCUMENTS

| | | | |
|---|---|---|---|
| 3,815,921 | 6/1974 | Turner | 273/174 |
| 4,332,388 | 6/1982 | Crow | 273/172 |
| 4,489,945 | 12/1984 | Kobayashi | 273/172 |
| 5,213,329 | 5/1993 | Okumoto et al. | 273/174 |

FOREIGN PATENT DOCUMENTS

| | | | |
|---|---|---|---|
| 4367678 | 12/1992 | Japan | 273/167 H |
| 5-305162 | 11/1993 | Japan . | |

*Primary Examiner*—William M. Pierce
*Attorney, Agent, or Firm*—Quarles & Brady

[57] ABSTRACT

A golf club head for lowering the center of gravity of a head body. A sole portion of the head body is formed with a concave portion, into which is fitted a denser balance weight of which the specific gravity is greater than that of the head body. The concave portion has a front end located at a face side of the sole portion, while a back end thereof is located backward relative to a center portion of the sole portion, said back portion protruding more backward at its toe side than at its heel side. According to the invention, the center of gravity G of a head body can be drastically lowered and the distance between the center of gravity G and a face can be elongated, thus enlarging so-called a sweet area without weakening a strength of the head body. Further, as the concave portion proturudes more backward at its toe side than its heel side, so-called slicing balls can be prevented.

6 Claims, 6 Drawing Sheets

HOLLOW CLUB HEAD WITH WEIGHTED SOLE PLATE

CROSS REFERENCE TO RELATED APPLICATIONS

This application is a divisional application of U.S. Ser. No. 245,874 filed on May 19, 1994, now pending.

BACKGROUND OF THE INVENTION (a) Field of the Invention

The present invention relates to a hollow golf club head, especially to so-called "metal wood".

(b) Description of Prior Art

There is provided a conventional metal wood golf club head disclosed in Japanese Patent Laid-Open No. 5-305162, wherein a face member, an upper surface member, a side peripheral member and a sole member are formed of metallic crusts made of titanium or titanium alloy or the like respectively. These crusts are integrally combined with a hosel member for attaching a shaft thereto, thereby forming a main head body. Subsequently, into the hosel member is inserted a distal end of the shaft, while the sole member is formed with a window aperture, to which is attached a diplay plate made of iron or beryllium copper alloy. In the above prior art, the denser display plate is provided in the sole member, thereby lowering the center of gravity of the main head body besides its display function.

According to the prior art, however, the denser display plate securely mounted in the window aperture is comparatively small, thus limiting the lowered length of the center of gravity of the head body. Further, the connection strength of the head body will be weakened by the window aperture.

SUMMARY OF THE INVENTION

To eliminate the above-memtioned problems, it is, therefore, an object of the present invention to further lower the center of gravity of a golf club head.

It is another object of the present invention to provide a golf club head which can prevent its head body from losing the connection strength even when the center of gravity of the head body is lowered.

It is further an object of the present invention to provide a golf club head with which a player can easily hit golf balls on the green.

According to a major feature of the present invention, a golf club head comprises: a sole portion of the head body formed with a concave portion protruding toward the inside of the sole portion; a balance weight provided in the concave portion in order to be located on approximately the same plane relative to the sole portion, the balance weight being formed of material having larger specific gravity than that of the head body.

BRIEF DESCRIPTION OF THE DRAWINGS

Other objects, features and advantages of the invention will be apparent to those skilled in the art from the following description of the preferred embodiments of the invention, wherein reference is made to the accompanying drawings, of which.

DETAILED DESCRIPTION OF THE PREFERRED EMBODIMENTS

Figure 1:
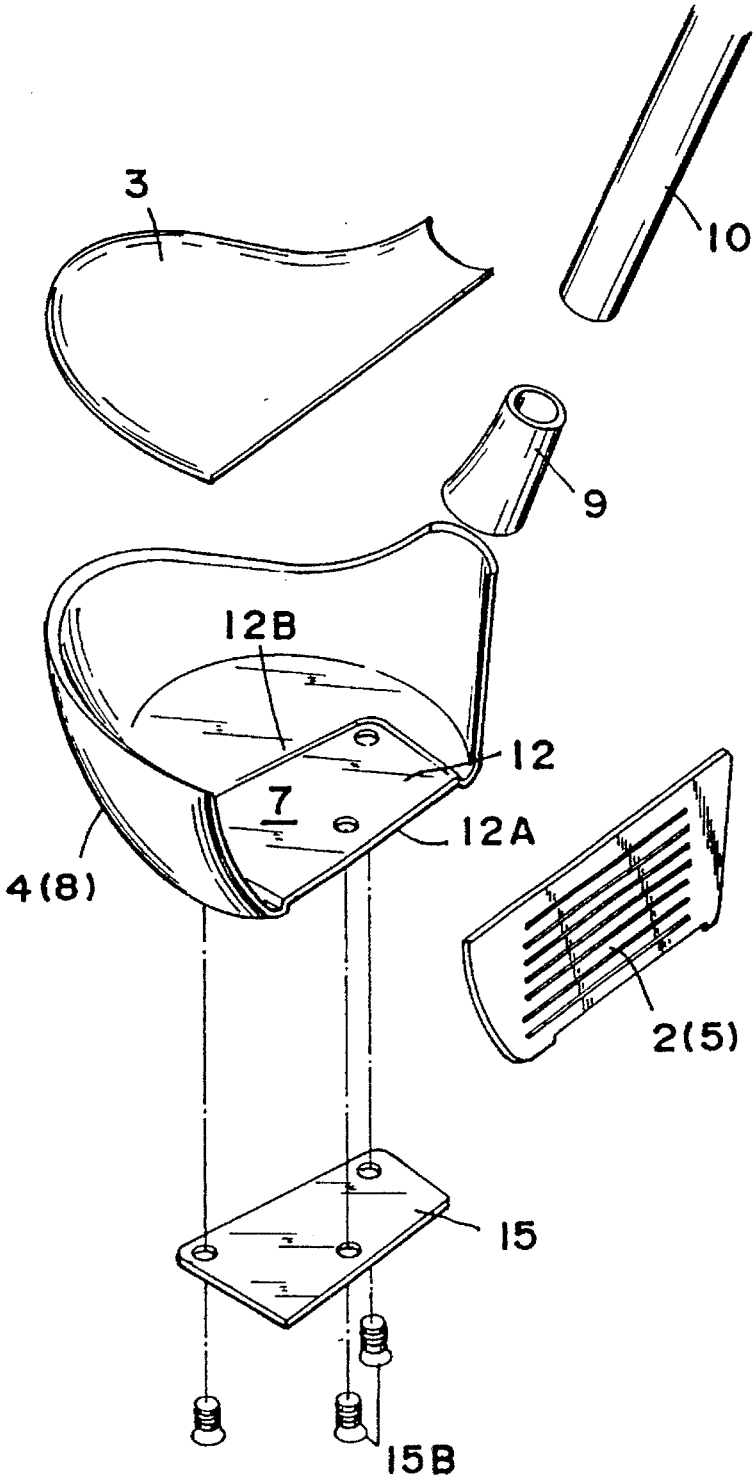
FIG. 1 is an exploded perspective view showing a first embodiment of the invention.
Figure 2:
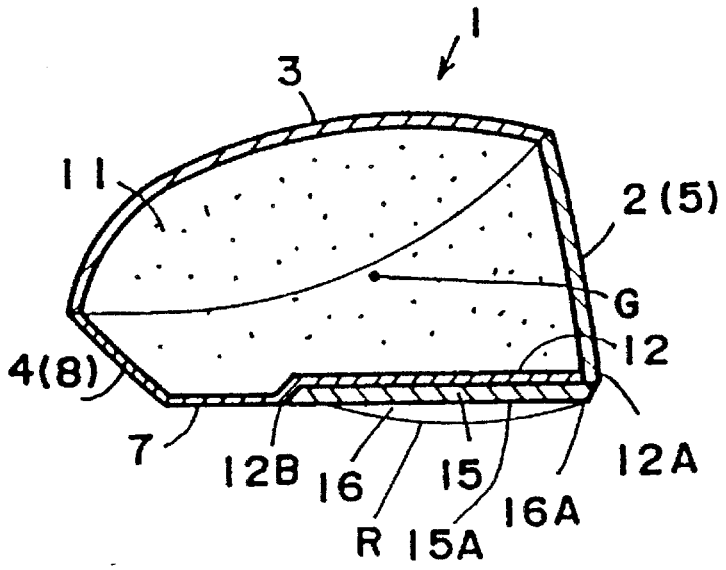
FIG. 2 is a cross-sectional view showing a first embodiment of the invention.
Figure 3:
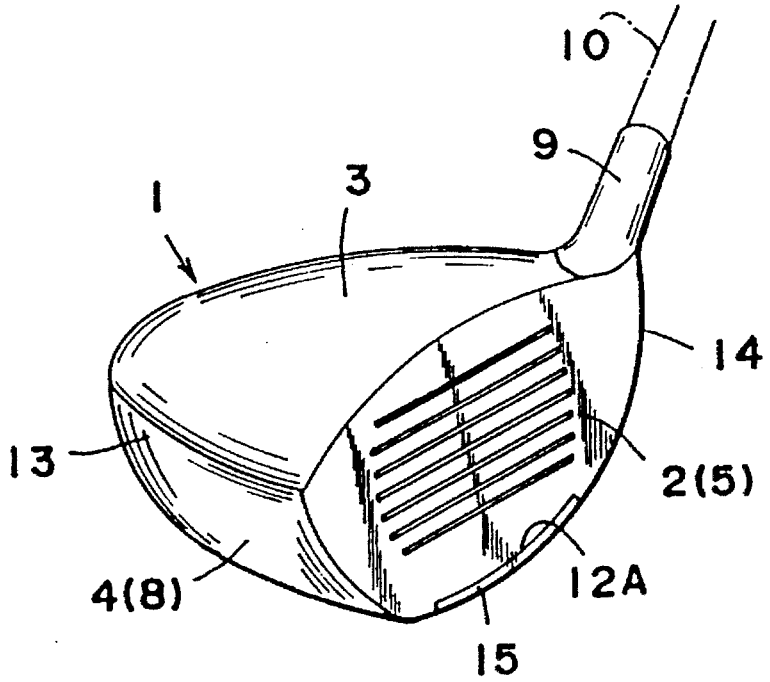
FIG. 3 is a perspective view showing a first embodiment of the invention.
Figure 4:
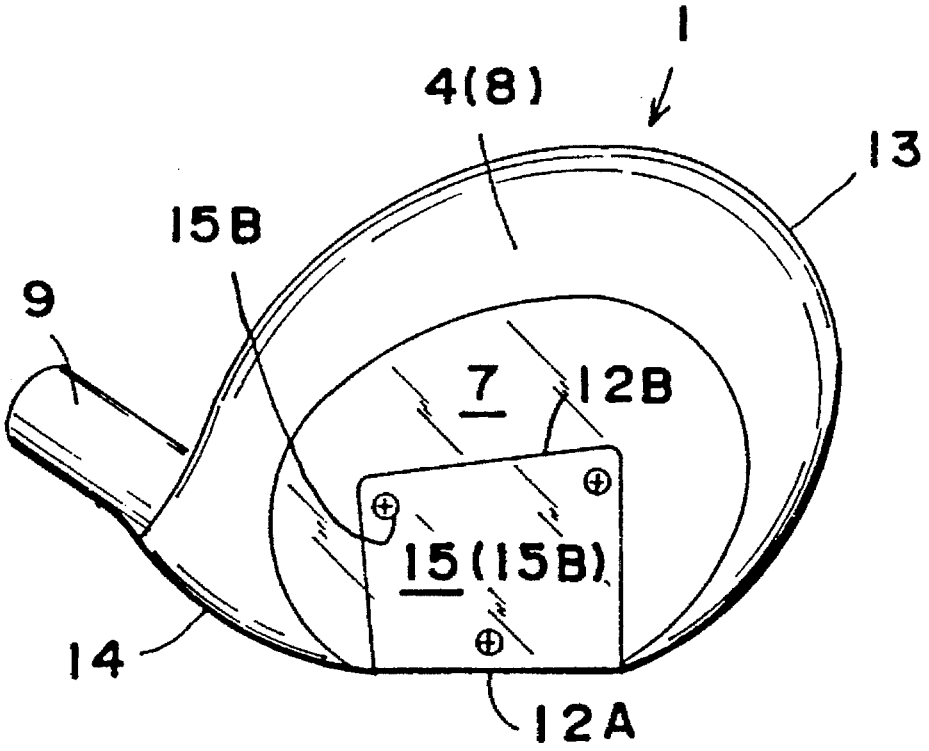
FIG. 4 is a bottom plan view showing a first embodiment of the invention.
Figure 5:
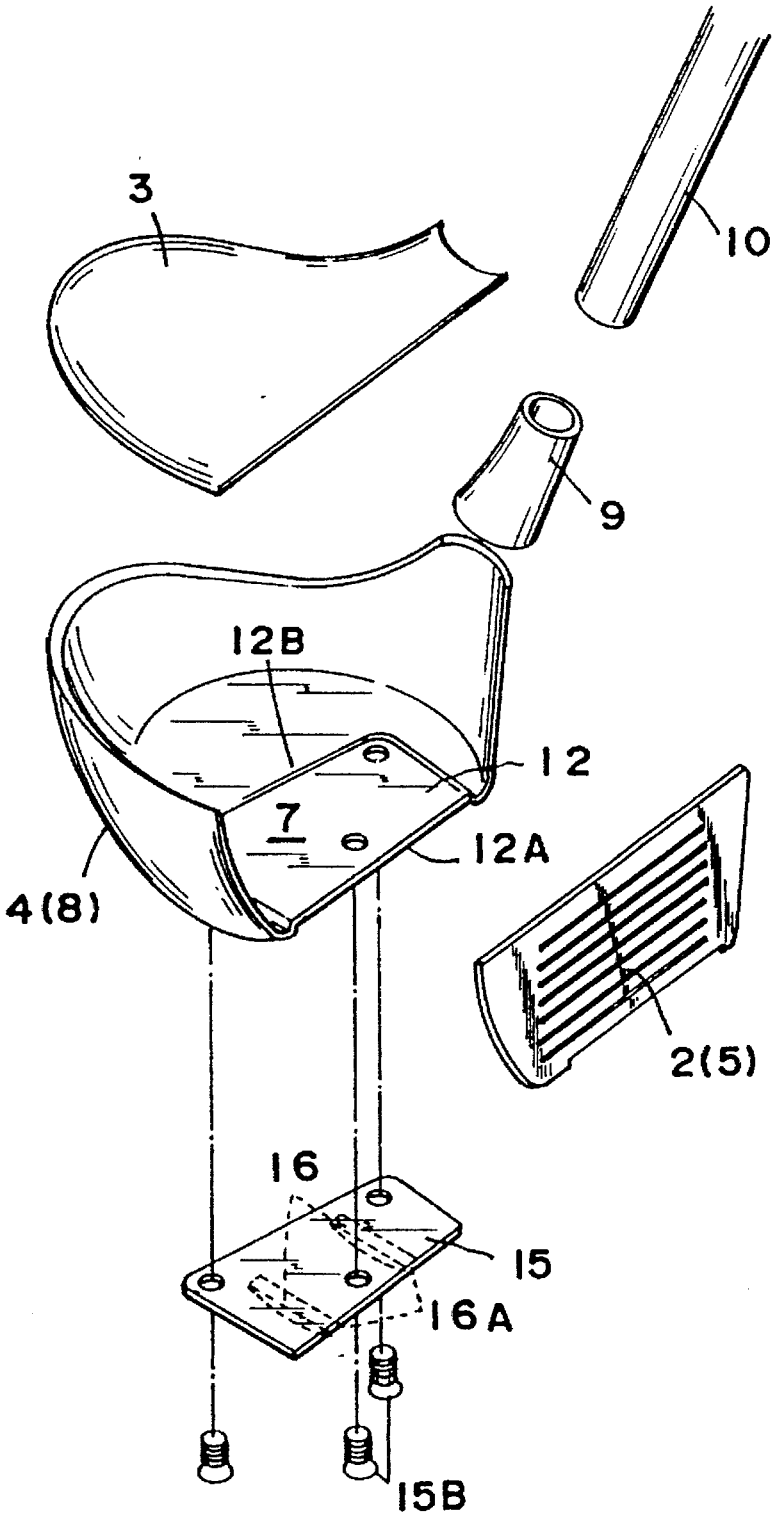
FIG. 5 is an exploded perspective view showing a second embodiment of the invention.
Figure 6:
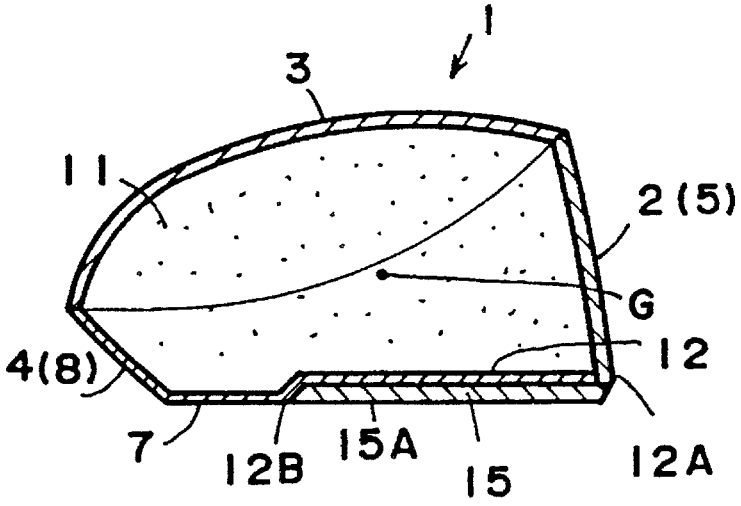
FIG. 6 is a cross-sectional view showing a second embodiment of the invention.
Figure 7:
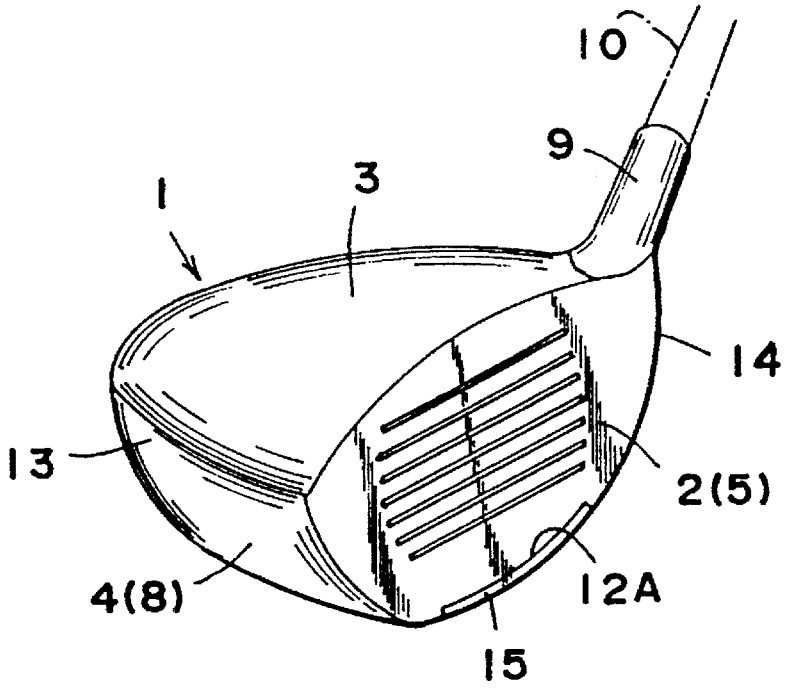
FIG. 7 is a perspective view showing a second embodiment of the invention.
Figure 8:
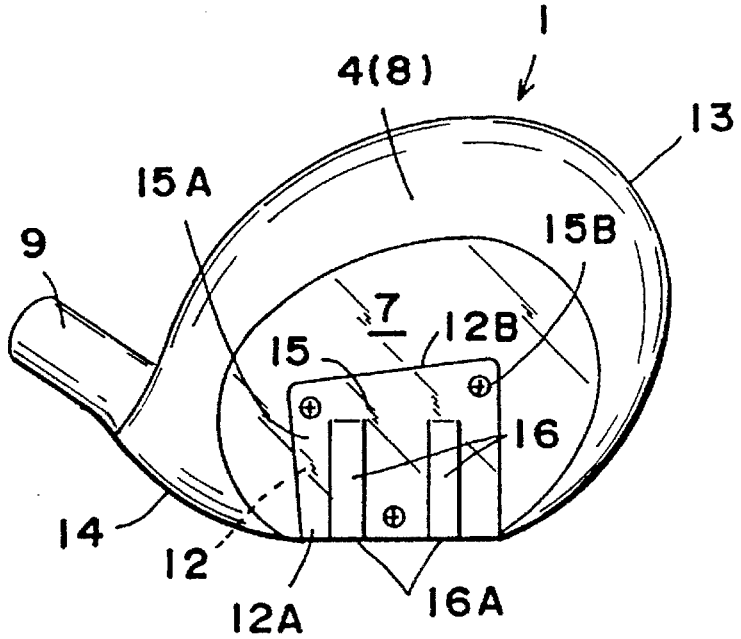
FIG. 8 is a bottom plan view showing a second embodiment of the invention.

Hereinafter is described a first embodiment of a golf club head of the invention with reference to FIGS. 1 to 4, in which reference numeral 1 designates a head body. The head body 1 is formed by integrally welding each edge of a face member 2, an upper surface member 3 and a side peripheral and sole member 4 after said each member is made of metallic crust by means of press-working of metal plates of pure titanium, titanium alloy, stainless steel, iron or the like. Preferably, pure titanium (the specific gravity: neary 4.5) or titanium alloy may be employed for the metallic material as its specific gravity is the smallest of the above metallic material. Thus, the volume of the head body can be enlarged up to more than 210 cc within a regular entire weight thereof by employing the above pure titanium or titanium alloy.

A front surface of the face member 2 is formed with a face 5 as a hitting surface, while a lower portion of the side peripheral and sole member 4 is formed with a sole 7 with a side peripheral portion 8 forming lateral side-walls and a back wall. Further, to one side of the said peripheral portion is connected a shaft 10 through a hosel 9. The hosel 9 is, for example formed by forged pure titanium, titanium alloy, stainless steel or iron plates. Preferably, pure titanium or titanium alloy is more suitable for lightening. Reference numeral 11 designates foam material such as urethane foam filled into an interior of the head body 1.

Additionally, the sole 7 is integrally provided with a concave portion 12 by press working or the like, said concave portion 12 being protruding toward inside of the sole 7. A front end 12A of the concave portion 12 is located at the face 5 side of the sole 7, while its back end 12B is located backward relative to a center portion of the sole 7. In addition, a toe 13 side of the back end 12B is located slightly backward relative to its heel 14 side.

Reference numeral 15 designates a thin-tabular weight formed of beryllium copper alloy (the specific gravity: nearly 8.2), copper, brass or stainless steel. The weight 15 is formed of approximately the same configuration with the concave portion 12 to be fitted thereinto, and screws 15B penetrate therethrough in order to secure the same to the sole 7. In addition, a lower surface 15A of the weight 15 is formed on approximately the same plane with respect to a sole plane except the concave portion 12.

In accordance with a first embodiment of the invention, the denser weight 15 is provided in the sole 7, thus the center of gravity of the head body 1 can be drastically lowered. Further, the mounting position of the weight 15 is formed by the concave portion 12, whereby the strength of the head body 1 will not be decreased. Furthermore, as the weight 15 is provided on approxinately the same plane relative to the sole 7, the sole 7 will not be caught in green in hitting balls. Additionally, as the toe side of the weight 15 is located slightly backward relative to the heel side thereof, so-called slice balls can be prevented. On the other hand, to prevent so-called hook balls, the heel 14 side of the weight 15 may be located slightly backward relative to its toe 13 side. In addition to the above advantages, as the volume of the head body 1 is more than 210 cc, preferably within a range of 210 cc to 300 cc, the head body 1 can be large-sized, preventing the sense of unsteadiness in hitting balls.

In FIGS. 5 to 8 showing a second embodiment of the invention, the same portions as those described in a first embodiment will be designated at common reference numerals, and their repeated detailed description will be omitted.

The face member 2, upper surface member 3, side peripheral and sole member 4 are integrally combined to form the head body 1 having a volume of more than 210 cc within a regular whole weight thereof. In the sole 7 is provided the concave portion 12 protruding toward the inside of the head body 1. The front end 12A of the concave portion 12 is located at the face 5 side of the sole 7, while its back end 12B is located backward relative to a center portion of the sole 7. In addition, the toe 13 side of the back end 12B is located slightly backward relative to its heel 14 side.

Reference numeral 15 designates the thin-tabular weight formed of beryllium copper alloy (the specific gravity: nearly 8.2), copper, brass. The weight 15 is formed of approximately the same configuration with the concave portion 12 to be fitted thereinto, thus screws 15B penetrate therethrough in order to secure the same to the sole 7. In addition, the lower surface 15A of the weight 15 is formed on approximately the same plane with respect to a sole plane except the concave portion 12.

Further, there are provided two ribs 16 integrally formed on the lower surface 15A of the weight 15. The two ribs have their proximal ends 16A located on the face 5 side respectively, which are spacedly disposed and extending in parallel, being circular-arc shaped from the face 5 toward the back. Each radius of curvature of the ribs 16 is provided so as to be nearly equal to swinging radius, i.e., the total sum of the length of a player's arm and the length of the shaft 10, thus preventing a golf club head from being caught in green by the ribs 16 when a player swings it.

As described above, in a second embodiment, there are further provided ribs 16 integrally formed on the weight 15, thus the contact of the sole 7 and the weight 15 with green can be linear-like contact, and a player can hit balls without his golf club head being caught in green, which is more remarkably attained by so forming the radius of curvature of the ribs 16 that it may be nearly equal to the swinging radius.

Figure 9:
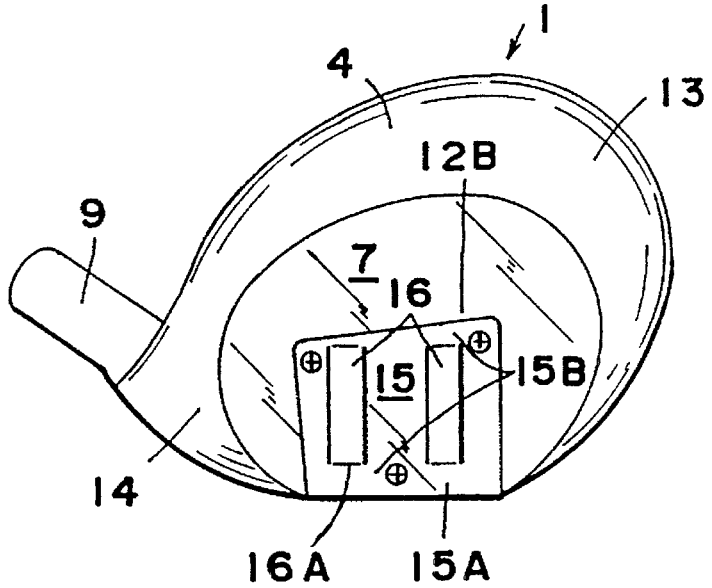
FIG. 9 is a bottom plan view showing a third embodiment of the invention.

Incidentally, the present invention should not be limited to those described in the forgoing embodiments. For example, as shown in FIG. 9, the proximal ends 16A of the ribs 16 may be located slightly backward relative to the face 5. Further, the number of the ribs may be three or more. Furthermore, the head body may be formed of four members such as a face member, an upper surface member, a side-peripheral member and a sole member.

What is claimed:

1. A golf club head having a metallic and hollow head body having an interior and exterior, said head body having a face for striking a golf ball and a sole portion extending rearwardly from said face along a bottom of the head body, comprising:

a sole portion of the head body formed with a concave portion expanding toward the interior of the head body;

a balance weight being provided in the concave portion, which is disposed on approximately the same plane with the sole portion, the balance weight being formed of material having a larger specific gravity than that of the head body, wherein a front end of said concave portion is located toward said face, while a back end of said concave portion is located rearwardly relative to a center portion of said sole portion, said back end extending farther at its toe side than at its heel side.

2. A golf club head having a metallic and hollow head body according to claim 1, further comprising two or more ribs slightly protruding toward the exterior of the head body, said ribs extending from the face of the head body rearwardly, wherein said ribs extend from said face rearwardly in parallel at preset intervals, said ribs having arc-shaped configurations along downwardly directed bottoms, said arc-shaped configurations each having a radius of curvature approximately equal to an orbital radius of the club head during swinging.

3. A golf club head having a metallic and hollow head body according to claim 2, wherein a front end of said concave portion is located toward said face, while a back end of said concave portion is located rearwardly relative to a center portion of said sole portion, said back end extending farther at its toe side than its heel side.

4. A golf club head having a metallic and hollow head body according to claim 2, wherein a front end of said concave portion is located toward said face, while a back end of said concave portion is located rearwardly relative to a center portion of said sole portion, said back end extending farther at its heel side than its toe side.

5. A golf club head having a metallic and hollow head body having an interior and exterior, said head body having a face for striking a golf ball and a sole portion extending rearwardly from said face along a bottom of the head body, comprising:

a sole portion of the head body formed with a concave portion expanding toward the interior of the head body;

a balance weight being provided in the concave portion, which is disposed on approximately the same plane with the sole portion, the balance weight being formed of material having a larger specific gravity than that of the head body, wherein a front end of said concave portion is located toward said face, while a back end of said concave portion is located rearwardly relative to a center portion of said sole portion, said back end extending farther at its toe side than at its heel side, two or more ribs slightly protruding toward the exterior of the head body, said ribs extending from slightly rearward of said face rearwardly in parallel at preset intervals, said ribs having arc-shaped configurations along downwardly directed bottoms, said arc-shaped configurations each having a radius of curvature approximately equal to an orbital radius of the club head during swinging.

6. A golf club head having a metallic and hollow head body having an interior and exterior, said head body having a face for striking a golf ball and a sole portion extending rearwardly from said face, comprising:

a sole portion of the head body formed with a concave portion expanding toward the interior of the head body;

a balance weight being provided in the concave portion, which is disposed on approximately the same plane with the sole portion, the balance weight being formed of material having a larger specific gravity than that of the head body, wherein a front end of said concave portion is located toward said face, while a back end of said concave portion is located rearwardly relative to a center portion of said sole portion, said back end extending farther at its heel side than at its toe side.

* * * * *